US008944387B2

(12) United States Patent
Wheeler

(10) Patent No.: US 8,944,387 B2
(45) Date of Patent: Feb. 3, 2015

(54) DEVICE FOR AUTOMATICALLY CONTROLLING SIGNALS AND MULTIPLE TRANS TRAVELING ON THE SAME TRACK

(76) Inventor: Gary Wheeler, Wall, NJ (US)

( * ) Notice: Subject to any disclaimer, the term of this patent is extended or adjusted under 35 U.S.C. 154(b) by 171 days.

(21) Appl. No.: 13/442,811

(22) Filed: Apr. 9, 2012

(65) Prior Publication Data

US 2012/0256057 A1 Oct. 11, 2012

Related U.S. Application Data

(60) Provisional application No. 61/472,831, filed on Apr. 7, 2011.

(51) Int. Cl.
*B61L 23/34* (2006.01)
*A63H 19/24* (2006.01)

(52) U.S. Cl.
CPC ..... *A63H 19/24* (2013.01); *A63H 2019/246* (2013.01)
USPC ..... 246/122 R; 246/187 R

(58) Field of Classification Search
USPC ..... 246/122 R, 123, 124, 122 A, 166.1, 246/167 R, 174, 175, 177
See application file for complete search history.

(56) References Cited

U.S. PATENT DOCUMENTS

| | | | | | |
|---|---|---|---|---|---|
| 1,909,316 | A * | 5/1933 | Richterkessing | ..... | 340/917 |
| 2,221,726 | A * | 11/1940 | Sorensen | ..... | 246/34 R |
| 2,250,235 | A * | 7/1941 | Reichard | ..... | 246/63 C |
| 2,280,491 | A * | 4/1942 | Kemmerer | ..... | 246/33 |
| 2,884,517 | A * | 4/1959 | Huffman et al. | ..... | 246/34 R |
| 3,015,722 | A * | 1/1962 | Pascoe | ..... | 246/5 |
| 3,037,461 | A * | 6/1962 | Barry | ..... | 104/18 |
| 3,192,382 | A * | 6/1965 | Allison | ..... | 246/187 R |
| 3,213,275 | A * | 10/1965 | Garrett et al. | ..... | 246/3 |
| 3,287,555 | A * | 11/1966 | Livingston et al. | ..... | 246/187 B |
| 4,022,407 | A * | 5/1977 | Staples | ..... | 246/34 R |
| 2012/0256057 | A1 * | 10/2012 | Wheeler | ..... | 246/122 R |

* cited by examiner

*Primary Examiner* — Jason C Smith

(57) ABSTRACT

An electrical device not only controls train signals as trains advance, but also alters the voltage in the tracks leading up to the signals so that the trains will actually stop at a red signal, slow at an amber aspect and continue on at full speed when the signal is showing green. The electrical device of the present invention can change the "block signal" from "green" to "red", thereby signaling the engineer behind the train to come to a stop. In addition, the electrical device can simultaneously change the voltage in the tracks to stop the approaching train at the red signal. Only when the forward train has cleared will the approaching train get a clear signal and voltage to resume its forward progress.

9 Claims, 3 Drawing Sheets

DEVICE FOR AUTOMATICALLY CONTROLLING SIGNALS AND MULTIPLE TRANS TRAVELING ON THE SAME TRACK

CROSS-REFERENCE TO RELATED APPLICATIONS

This application claims the benefit of priority of U.S. provisional patent application No. 61/472,831, filed Apr. 7, 2011, the contents of which are herein incorporated by reference.

BACKGROUND OF THE INVENTION

The present invention relates to train traffic control and, more particularly, to a device that automatically controls signals and multiple trains traveling on the same track.

Model railroaders forever have had to constantly "be at the throttle" to manually control two (or more) trains traveling along the same track. Moreover, while railroad signals look nice by changing colors they are strictly "show pieces". They turn from green to red, then to amber and back to green again. These colors, however, are meaningless. The next train doesn't stop or slow, it keeps barreling right along until it rear ends the train in front of it.

With passenger trains, including subways and high speed rails, an operator is often relied upon for watching for signals to control train speeds and other operating conditions. However, if the operator has a medical emergency or is in some other way distracted, they could miss these signals, potentially resulting in a dangerous situation for the train operator and passengers.

As can be seen, there is a need for a device that can automatically control signals and trains traveling on the same track.

SUMMARY OF THE INVENTION

In one aspect of the present invention, a train control device comprises a first relay and a second relay, the first and second relays being four-pole, double throw relays; a voltage input providing a first voltage input, a second voltage input and a third voltage input; first, second and third signal outputs adapted to send power to a signal; and a train power output adapted to send train power to a train block based on train position.

In another aspect of the present invention, a train control device comprises a first relay and a second relay, the first and second relays being four-pole, double throw relays; a voltage input providing a first voltage input, a second voltage input and a third voltage input; a signal output adapted to send power to a signal; and a train power output adapted to send train power to a train block based on train position, wherein the first voltage input is a go signal, wherein the go signal is sent to the train power output when a train is not present on an immediately forward block and one or more subsequent forward blocks; the second voltage input is a yield signal, wherein the yield signal is sent to the train power output when a train is not present on an immediately forward block, but is present in one or more subsequent forward blocks; and the third voltage input is a stop signal, wherein the stop signal is sent to the train power output when a train is present in an immediately forward block.

These and other features, aspects and advantages of the present invention will become better understood with reference to the following drawings, description and claims.

DETAILED DESCRIPTION OF THE INVENTION

Figure 1:
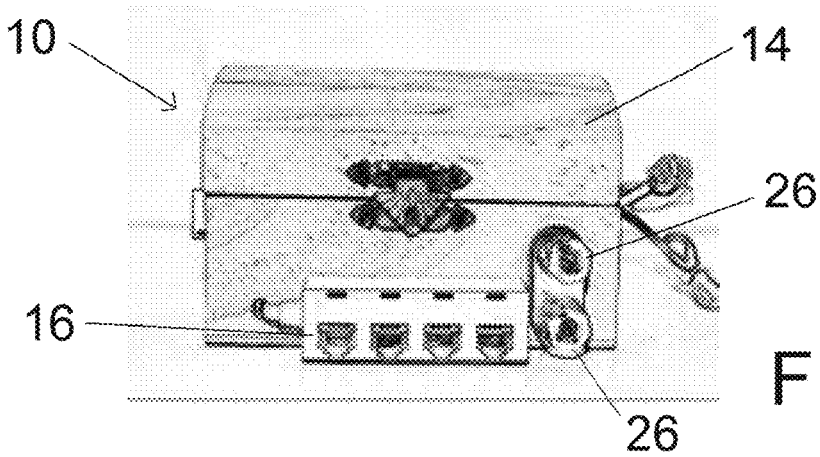
FIG. 1 is a front view of an anti-collision device according to an exemplary embodiment of the present invention.
Figure 2:
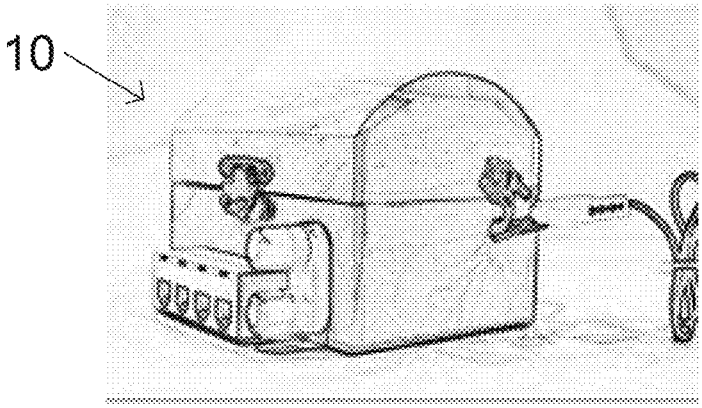
FIG. 2 is a left front perspective view of the anti-collision device of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an electrical device that not only controls train signals as trains advance, but also alters the voltage in the tracks leading up to the signals so that the trains will actually stop at a red signal, slow at an amber aspect and continue on at full speed when the signal is showing green. The electrical device of the present invention can change the "block signal" from "green" to "red", thereby signaling the engineer behind the train to come to a stop. In addition, the electrical device can simultaneously change the voltage in the tracks to stop the approaching train at the red signal. Only when the forward train has cleared will the approaching train get a clear signal and voltage to resume its forward progress.

Railroad tracks are separated into sections called "blocks". The length of the block is usually determined by the terrain and the speed of the train (which can be correlated with sight lines and stopping distances). Each "block" is protected by a signal that changes from green to red when the train enters the block. This signal tells the next train approaching the block that the block is occupied, and the engineer must stop. If the signal is at a "yield" color, the engineer can proceed slowly with caution.

Referring now to the Figures, an electrical device 10 may include a circuit 12 (see FIG. 7) housed in a housing 14. From each electrical device 10, four electrical connection ports 16 may be provided for providing the appropriate input voltages, including stop, yield, and go power signal voltages, as well as the signal voltage. Two output ports 26 may be provided, one of which provides a signal to a signal 18, the other of which may provide power to the third rail of the track. The go power signal voltage may be, for example, a full voltage signal of 20-24V. The yield power signal voltage may be a medium voltage signal of 12-14V. The stop power signal voltage may be a low voltage signal of 6V. Of course, depending on the system, these voltages for each of the three signals may vary. These signals are usually carried on the "third rail" of the train track. The voltage on the third rail is completely dependent on the location(s) of the trains on the track.

Figure 3:
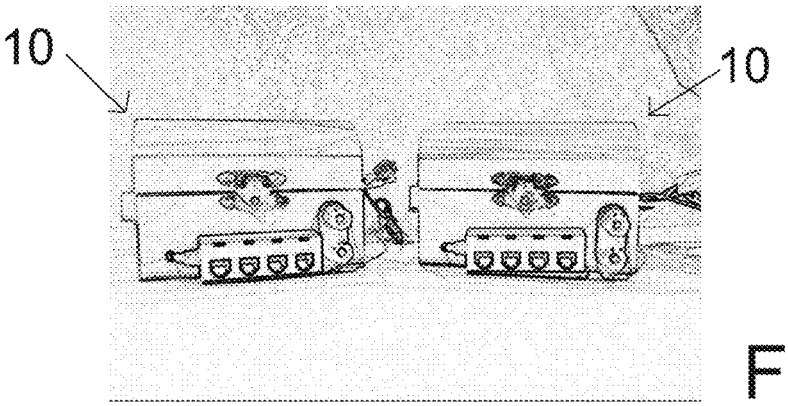
FIG. 3 is a front view of two anti-collision devices electrically connected together according to an exemplary embodiment of the present invention.
Figure 4:
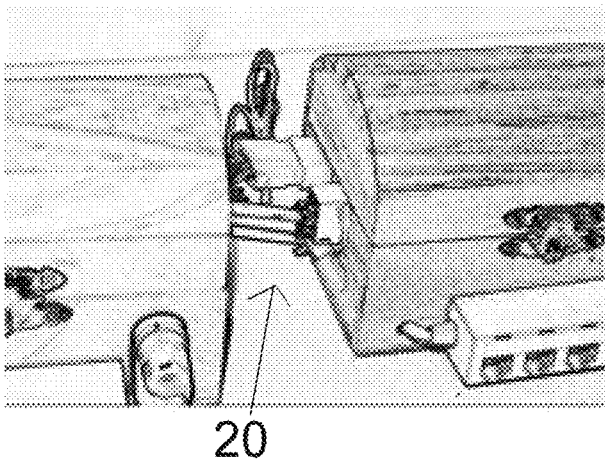
FIG. 4 is a close up view showing the electrical connection of the two anti-collision devices of FIG. 3.
Figure 5:
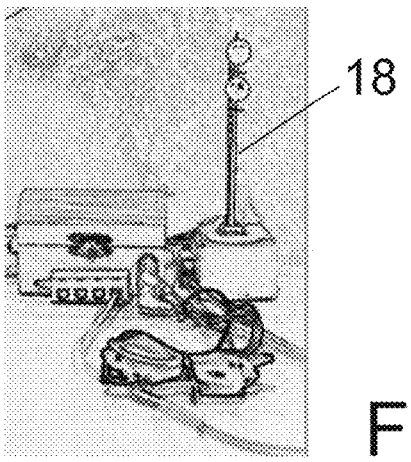
FIG. 5 is a perspective view of the anti-collision device of FIG. 1 connected to a signal.
Figure 6:
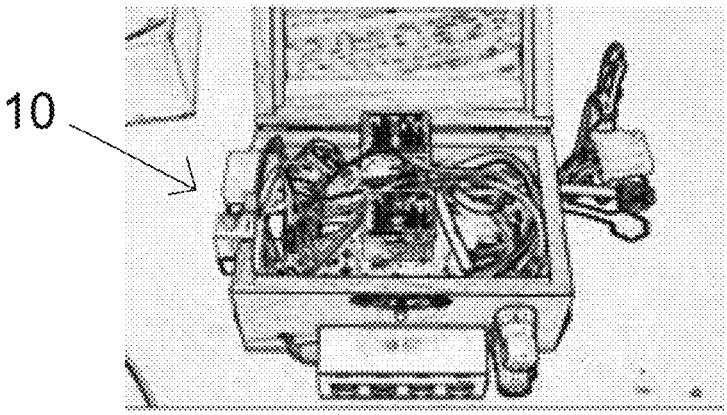
FIG. 6 is a perspective view of the anti-collision device of FIG. 1 with its top open.

The electrical device 10 may include a mechanism, such as a plug and socket 20, to link multiple ones of the electrical devices in series (See FIG. 3, for example). For example, if a train system has 3 blocks, three of the electrical devices 10 may be linked together to provide the 3 signal generation ports for each of the blocks.

Figure 7:
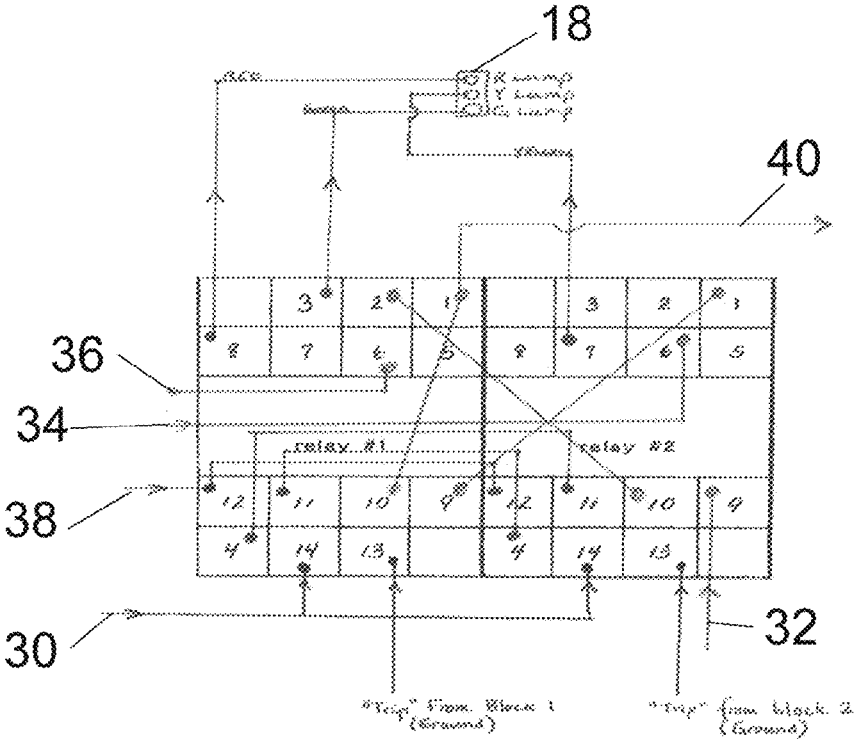
FIG. 7 is a schematic view of an electrical wiring diagram for the anti-collision device of FIG. 1.

The circuit, as shown in FIG. 7, may use a first relay 22 and a second relay 24. Each of the relays 22, 24 may be 4-pole, double throw relays. These relays 22, 24 are used to effectively change the track voltage and the trackside signal reflecting the voltage change. A power source may provide power to the relays via line 30. For example, a transformer (not shown) may provide a 14V power supply for the relays. A go signal input 32 may receive the go signal voltage. A yield signal input 34 may receive the yield signal voltage. A stop signal input 36 may receive the stop signal voltage. A signal voltage line 38 may input the voltage to be fed to the signal 18. A third rail output voltage may be carried by output line 40.

Figure 8:
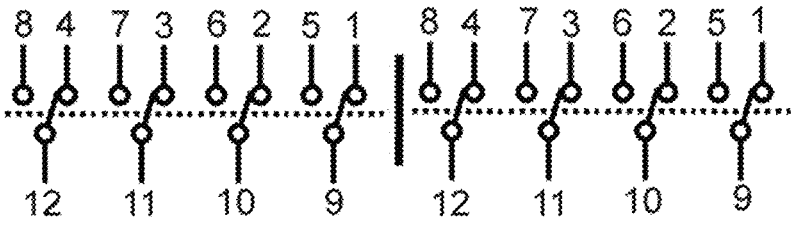
FIG. 8 is a schematic view showing the electrical switching of relays in the anti-collision device of FIG. 1.

One electrical device 10 may be disposed for each block. The relays 22, 24 may be controlled depending on a location of a train on that particular block. For example, the relays may be both in a first position, as shown in FIG. 8, to provide a go signal when there is no other train on that block or one or more forward blocks. When a train is present in a block, the voltage to the immediate prior block may be at the stop voltage and the first relay 22 may be in a second position (opposite that shown in FIG. 8). When a train is in a particular block, adjacent block(s) behind the "stop block" may be in a yield designation. In this designation, the relays 22, 24 may both be in the second position (opposite that shown in FIG. 8).

For example, when a train enters a block, the signal 18 for that block changes to red and simultaneously, the voltage to the approaching block drops to a stop voltage (such as 6V). This voltage is enough to keep the train's electrical systems running, but not enough to run the motor, thus the train stops. The next block behind the block with the stop voltage may be set to "yellow" or a yield signal of about 12-14V, for example, which allows a nice, slow steady speed.

It should be understood, of course, that the foregoing relates to exemplary embodiments of the invention and that modifications may be made without departing from the spirit and scope of the invention as set forth in the following claims.

What is claimed is:

1. A train control device comprising:

a first relay and a second relay, the first and second relays being four-pole, double throw relays;

a voltage input providing a first voltage input, a second voltage input and a third voltage input;

first, second and third signal outputs adapted to send power to a signal; and a train power output adapted to send train power to a train block based on train position;

wherein the third voltage input is a stop signal; and wherein the stop signal is sent to the train power output when a train is present in an immediately forward block.

2. The train control device of claim 1, wherein the first voltage input is a go signal, wherein the go signal is sent to the train power output when a train is not present on an immediately forward block and one or more subsequent forward blocks.

3. The train control device of claim 1, wherein the second voltage input is a yield signal, wherein the yield signal is sent to the train power output when a train is not present on an immediately forward block, but is present in one or more subsequent forward blocks.

4. The train control device of claim 1, wherein the train power output is provided to a third rail of a train track.

5. The train control device of claim 1, wherein:

terminal one of the first relay provides the train power output and is interconnected to terminal ten of the first relay;

terminal two of the first relay is interconnected to terminal 10 of the second relay;

terminal three of the first relay provides power to a green lamp of a signal;

terminal four of the first relay is interconnected to terminal eleven of the second relay;

terminal six of the first relay receives the third voltage input;

terminal eight of the first relay provides power to a red lamp of the signal;

terminal nine of the first relay is interconnected to terminal one of the second relay;

terminal eleven of the first relay is interconnected to terminal four of the second relay;

terminal twelve of the first relay receives a signal power voltage and is interconnected to terminal twelve of the second relay;

terminal thirteen of the first relay receives a switch signal for the first relay;

terminal fourteen of the first relay receives a relay voltage;

terminal six of the second relay receives the second voltage input;

terminal seven of the second relay provides power to a yellow lamp of the signal;

terminal nine of the second relay receives a first voltage input;

terminal thirteen of the second relay receives a second switch signal for the second relay; and terminal fourteen of the second relay receives the relay voltage.

6. The train control device of claim 1, further comprising a signal input voltage interconnected with the first, second and third signal outputs.

7. A train control device comprising:

a first relay and a second relay, the first and second relays being four-pole, double throw relays;

a voltage input providing a first voltage input, a second voltage input and a third voltage input;

a signal output adapted to send power to a signal; and a train power output adapted to send train power to a train block based on train position, wherein the first voltage input is a go signal, wherein the go signal is sent to the train power output when a train is not present on an immediately forward block and one or more subsequent forward blocks;

the second voltage input is a yield signal, wherein the yield signal is sent to the train power output when a train is not present on an immediately forward block, but is present in one or more subsequent forward blocks; and the third voltage input is a stop signal, wherein the stop signal is sent to the train power output when a train is present in an immediately forward block.

8. The train control device of claim 7, wherein the train power output is provided to a third rail of a train track.

9. The train control device of claim 7, further comprising a signal input voltage interconnected with the first, second and third signal outputs.

* * * * *